United States Patent [19]

Eisenmann

[11] 4,398,874

[45] Aug. 16, 1983

[54] GEAR RING PUMP

[76] Inventor: Siegfried Eisenmann, Conchesstrasse 25, 7960 Aulendorf, Fed. Rep. of Germany

[21] Appl. No.: 279,042

[22] Filed: Jun. 30, 1981

[30] Foreign Application Priority Data

Jul. 10, 1980 [DE] Fed. Rep. of Germany ..... 3026222

[51] Int. Cl.[3] ..... F04C 2/10

[52] U.S. Cl. ..... 418/171; 74/804

[58] Field of Search ..... 418/170, 171, 166, 167; 74/805, 804

[56] References Cited

U.S. PATENT DOCUMENTS

| | | | |
|---|---|---|---|
| 892,295 | 6/1908 | Nvtz | 418/171 X |
| 1,341,846 | 6/1920 | Gollings | 418/171 X |
| 1,516,591 | 11/1924 | Edwards | 418/171 X |
| 2,091,317 | 8/1937 | Hill | 418/171 X |
| 3,619,093 | 11/1971 | Harle et al. | 418/171 X |
| 3,907,470 | 9/1975 | Harle et al. | 418/170 |
| 4,155,686 | 5/1979 | Eisenmann et al. | 418/170 |

FOREIGN PATENT DOCUMENTS

| | | | |
|---|---|---|---|
| 2758376 | 7/1979 | Fed. Rep. of Germany | 418/170 |
| 838270 | 3/1939 | France | 418/171 X |
| 606006 | 5/1978 | U.S.S.R. | 418/171 |

*Primary Examiner*—Leonard E. Smith

*Attorney, Agent, or Firm*—Michael J. Striker

[57] ABSTRACT

A gear ring pump has a housing with an inner hollow and a suction and pressure side, a hollow gear arranged in the housing and provided with between eight and sixteen teeth, and a driven pinion provided with teeth having by one tooth less than the hollow gear and engaging with the hollow gear so as to form a region of deepest engagement and a region which is opposite to the latter. The teeth heads of the pinion slide over the teeth of the hollow gear in the opposite region whereas the driving teeth flanks of the pinion abut against the teeth of the hollow gear in the region of deepest engagement so as to provide sealing between the suction side and pressure side. The teeth are formed so that the teeth heads of the pinion are freely received into the teeth gaps of the hollow gear and the teeth of the pinion has a shape determined by rolling of the pinion over the hollow gear. The teeth of the hollow gear have an approximately trapezoidal shape with convexly curved flanks and heads.

15 Claims, 5 Drawing Figures

GEAR RING PUMP

BACKGROUND OF THE INVENTION

The present invention relates to a gear ring pump.

Gear ring pumps are known in the art. A known gear ring pump has a housing, a hollow gear arranged rotatable in the housing and having 5–16 teeth and engaging with a pinion which is driven from a driving shaft and also has teeth which are by one tooth less than the hollow gear. The sealing between a suction space and a pressure space is performed by sliding of the teeth heads of the pinion over the teeth of the hollow gear at a location which is opposite to the location of the deepest teeth engagement, and by abutment of the driving teeth flanks of the pinion against the teeth of the hollow gear at the location of the deepest teeth engagement. The teeth heads of the pinion are freely received in the teeth gaps of the hollow gear, and the theoretical teeth shape of the pinion is determined by rolling of the pinion rolling circle over the hollow gear rolling circle. Such a tooth ring pump is known for a long time and disclosed, for example, in "Lueger Lexikon der Technik", Deutsche Verlagsanstalt, Stuttgart, Bd.7, 1965, S. 218. These pumps are identified there as "Eaton pumps". The above discribed pumps have a simple construction. The teeth of the hollow gear are generally formed as circular segments; in other words, the entire tooth contour is determined by a single circular arc. Instead of the circular arc contour it is also possible, however, to use (as well as in the present invention) another curve, for example a cycloid. A considerable problem with the above-described known Eaton-gearing is that each tooth of the hollow gear is constantly in engagement with a tooth of the pinion. This is performed in a construction in which the pinion has by only one tooth less than the hollow gear. The feature that all teeth are always in engagement causes considerable problems not only during the manufacture but also during the operation of the gearing. The manufacture must be very accurate, on the one hand. When wear takes place during the operation, the sealing between the suction space and the pressure space of the pump, particularly at a location which is opposite to the location of deepest engagement, is imperfect and the effectiveness of the pump considerably reduces. Moreover, the pump is suceptible to wear, because during the operation a very strong specific sliding between the abutting parts of the pinion teeth and the hollow gear teeth takes place. This takes place, first of all because the teeth surfaces of the hollow gear which correspond to the teeth flanks of a normal gear are relatively considerably inclined. Moreover, parts of the pinion teeth which directly transmit torque and abut against the teeth of the hollow gear, namely abut against the relatively sharply curved edges between the teeth flanks and the teeth heads are characterized by especially high hertz pressure which additionally stimulates the wear. Furthermore, the oscillation of the instantaneous supply volume over the rotary angle and thereby the supply pulsation of this pump are very high.

An additional problem of the Eaton-pump is that the individual supply means limited in radial direction by the hollow gear and the pinion, constantly change their volumes, since they are separated from one another by the multiple teeth engagement. This leads to a subdivision of the working space into individual chambers, which is undesirable also when they communicate with one another by laterally arranged pockets in the housing.

Finally, the multiple teeth engagement of the Eaton pump has the disadvantage that the real teeth engagement for the torque transmission from the pinion to the hollow gear in circumferential direction, which is under hertz pressure, is frequently remote from the position of the deepest teeth engagement because of manufacture tolerances of the teeth flanks shape of the hollow gear and of the pinion. Because of the thereby varying angle position of the pressure points between the teeth flanks of the pinion and the hollow gear, a teeth force component generated on the hollow gear tends to increase the axes distance between both gears. As a result of this, the sealing between the teeth at the location opposite to the deepest engagement becomes worse, and the thus increased teeth force is higher in dependence upon the higher supply pressure. Because of the above described reasons, the Eaton pump, despite its simple construction, is implemented in practice to only a limited extent for relatively few cases.

The disadvantages of the Eaton pumps with a teeth number difference of more than one, in which the teeth in the region opposite to the deepest teeth engagement are not in engagement, are eliminated in a construction in which in the region of the above-mentioned location a filling piece having generally the shape of a half moon or sickle is arranged so that the teeth heads of the hollow gear slide along its convex surface, whereas the teeth heads of the pinion slide along its concave surface. In such a construction there is more freedom for the teeth shape so that the teeth engagement characteristics can be favorably selected. However, these pump types are considerably more expensive than the Eaton pump because of the expenditure for the filling piece and the exact positioning and the shape of the latter.

SUMMARY OF THE INVENTION

Accordingly, it is an object of present invention to provide a gear ring pump which avoids the disadvantages of the prior art.

More particularly, it is an object of the present invention to provide a gear ring pump in which the teeth surfaces of the pinion and the hollow gear which are in driving interengagement slide less over one another and abut against one another over a greater surface, whereby the hertz pressure is reduced.

It is also an object of the present invention to provide a gear ring pump in which the supply chambers between a respective teeth pair of the pinion and the hollow gear are large.

It is another object of the present invention to provide a gear ring pump in which the disadvantage of the continuous volume variation of the above-mentioned supply chambers is at least considerably eliminated, and the gear-ring is less susceptible to distortion than the known Eaton gearing. Moreover, it is also an object of the present invention to provide a gear ring pump which has an improved smoothness of running and reduced danger of oil film stripping.

Finally, it is also an object of the present invention to provide a gear ring pump with an engagement-free region which eliminates the connection of the drive engagement with the sealing engagement located opposite thereto.

In keeping with these objects, the invention provides for improvement of the engagement condition and the above-mentioned condition existing in the Eaton pump, with such a construction in which the hollow gear is subdivided into two parts, namely a region which is driven and located at the location of deepest teeth engagement, and a further teeth heads region which has the only purpose to seal the location which is opposite to the location of deepest teeth engagement. The first feature of the present invention is attained by the fact that two Eaton hollow gearings with arcuate tooth contour and a number of teeth which is half of the desired teeth number are superimposed over one another with displacement in circumferential direction by one half of the teeth pitch, and only those parts of the teeth are available which are overlapped by the teeth of both gearings. In this case each teeth contour arc of the original Eaton gear ring overlaps two of the remaining teeth which have a substantially triangular shape with convexly curved flanks. The teeth curve determines both oppositely facing teeth flanks of two neighboring teeth. In this case, only relatively steep teeth root regions of the original Eaton gearing profile remains available for the teeth engagement so as to provide for favorable engagement conditions. The thus produced teeth profile does not provide, however, constant sealing at the location which is opposite to the location of deepest teeth engagement. In order to make possible the same, a third Eaton gearing is superimposed whose pitch is equal to half the pitch of the original full Eaton gearing. The center of the teeth arcs of this Eaton gearing coincides with the center of the "triangular teeth" and cut off the triangular tips. This cutting must have in all cases such a height that the thus produced teeth head surfaces are sufficiently wide in circumferential directions to guarantee that the forward ends of two neighboring hollow gear teeth at the opposite location to the deepest engagement disengage from the pinion not earlier than at the moment when the following hollow gear tooth is in engagement with the pinion.

In such an inventive construction the teeth heads running of the Eaton gearing is also available, which is very favorable for the sealing at the location opposite to the deepest teeth engagement, flat, and arcuate. Since the teeth tips are cut off, the theoretical overlapping degree is equal to below the value 1. This, however, does not have any undesirable influence for the gearing of the invention when the hollow gear does not have less than eight teeth. It is also possible, to provide the hollow gear with less than eight teeth. For this case a profile offset of the pinion tooth is necessary for maintaining suitable engagement conditions.

An additional important criterion of the gearing in accordance with the invention is that the rolling circle of the hollow gear runs in the region of the theoretical teeth roots of the hollow gear, and the respective rolling circle of the pinion runs in the region of the theoretical teeth heads of the pinion. This requirement with respect to the rolling circles must not, however, be satisfied completely; it can be satisfied approximately. At least the rolling circle of the hollow gear must be located outside the circle about the hollow gear center by the lower third of the teeth height of the hollow gear. With greater number of teeth, the rolling circle of the hollow gear is also located substantially outside of the root circle of the hollow gear. This is true particularly for the teeth numbers over 10. Analogously, the rolling circle of the pinion must be offset inwardly or outwardly by the corresponding value. The inner displacement of the rolling circle can be required when the teeth number of the hollow gear is small, for example in the event of eight teeth.

Because of the fact that the rolling circle is substantially equal to the root circle of the hollow gear or the head circle of the pinion, it is guaranteed that the teeth in the regions between the location of deepest teeth engagement and the opposite location no longer contact each other. Thereby the problem of the varying supply chambers between two teeth pairs is eliminated. The problem of the undesirable intermediate teeth engagement is also eliminated.

The distinctive feature of the present invention is that a gear ring pump has a hollow gear with approximately trapezoidal teeth with convexly curved flanks and heads, and advantageously the rolling circle of the hollow gear coincides with its theoretical teeth roots circle, whereas the rolling circle of the pinion substantially coincides with its theoretical teeth heads circle.

When it is referred here to theoretical teeth roots circle, theoretical teeth head circle and other "theoretical" parameters, the attribute "theoretical" means that one does not deal with corresponding actual parameters, but with the parameters which take place in the event of ideal fully play-free and failure-free gearing without edge rounding.

When in accordance with the invention the teeth shape is completely symmetrical, which is known in the art, it is also possible to use an asymmetrical teeth shape. This is especially true when the pump is designed only for a predetermined rotational direction. In this case both Eaton gearing contours which define both teeth flanks of the teeth are not identical.

The construction of gearing in accordance with the present invention is relatively simple. When the diameter and the desired teeth number of the hollow gear is determined, then the teeth is produced from the requirement "teeth number difference=1". Now the theoretical teeth contour is produced with the aid of corresponding circular arcs or curved arcs, and naturally it must be considered, as in each Eaton gearing, that the corresponding teeth gaps are wide enough. Then the produced theoretical contour of the hollow gear is used for designing the theoretical contour of the pinion with the aid of drafting or analytically. Now the teeth gaps must be insignificantly deepened, and thereby the teeth heads are reliably received in the teeth gaps and no precision working is required at the bottom of the teeth gaps.

The teeth shape of the hollow gear is advantageously determined in such a manner that the extension of the teeth and the extension of the teeth gaps in circumferential direction at a circle through the half height of the teeth are substantially identical. This feature results in the fact that the theoretical teeth heads width of the hollow gear teeth is equal to approximately $\frac{2}{3}$ of the theoretical width of the teeth gaps on the root. Such a dimension leads not only to a relatively great supply volume measured with respect to the pump diameter, but also to steep teeth flanks.

Advantageously, the teeth heads width (without the subsequently produced rounding) of the hollow gear is equal to 0.65–0.7, and the width of the teeth gaps at the theoretical roots circle of the hollow gear is equal to 1.05–1.1 of the theoretical teeth height of the hollow gear. It has proved to be effective the construction in which the radius of curvature of the teeth heads of the hollow gear is equal to substantially 2–2.4, better 2.2–2.3, of the theoretical teeth height of the hollow gear. It is also highly advantageous when the radius of curvature of the teeth flanks of the hollow gear is equal to approximately 3.3–3.7, better 3.4–3.6, of the theoretical teeth height of the hollow gear. The radius of curvature of the teeth flanks in this sense is identical to that of the radius of curvature of the original Eaton gearing, from which the inventive gearing is produced by superposition and displacement by a half pitch of the original gearing.

The construction of the gear pump is especially simple when the convexity of the teeth heads of the hollow gear has a shape of a circular arc whose center is located on the radius line of the hollow gear through the tooth center outside of the teeth root circle, and the teeth flanks of the hollow gear extend along circular arcs whose center is also located outside of the teeth roots circle. Instead of the circular arcs, it is also possible to provide other curves, as mentioned above, with not exactly constant radius. The circular arcs have, however, the advantage in the easier theoretical determination because of the radius constancy.

In accordance with the given principle illustration of the invention, the teeth flanks facing away from one another of two neighboring teeth lie advantageously on a common circular arc. This feature is not, however, necessary. For example, two circular arcs with identical radius or different centers can be provided which extend on the line through the center of the hollow gear and the center of the teeth gaps between both neighboring teeth.

The construction is further simplified when the edges between the teeth flanks and the teeth heads of the hollow gear are rounded along a circular arc which gradually merges into the arc defining the teeth flanks and the arc defining the teeth heads and has a radius substantially corresponding to one-third of the theoretical teeth height of the hollow gear. A value of 0.3–0.33 of the theoretical teeth height of the hollow gear has proved to be advantageous. When this radius is made too small, it is necessary for avoiding notch effects at the teeth roots to make the same relatively deep. When this radius is made too great, the region opposite to the location of deepest teeth engagement in which the teeth heads of the hollow gear and the pinion unobjectionably abut against one another is too small, thereby there is a danger that a balance between suction space and pressure space takes place in a pulsating manner. In the event of designing of the pinion as a rolling body of the hollow gear, the edge rounding is located at the bottom.

In practice, the teeth number of a gear ring pump of the present invention is limited from above by the supply in accordance with a greater supply output of the pump and thereby the greatest possible teeth. Respectively, the teeth number of the hollow gear does not exceed 15 as a rule. Advantageously it is equal to 13. An especially advantageous region is located between 9 and 12 teeth for the hollow gear. A teeth number of the hollow gear equal to 10 is considered to be optimum to provide for a maximum supply output of the pump with given diameter.

The novel features which are considered characteristic for the invention are set forth in the appended claims. The invention itself, however, both as to its construction and its method of operation, together with additional objects and advantages thereof, will be best understood from the following description of preferred embodiments when read in connection with the accompanying drawing.

DESCRIPTION OF THE PREFERRED EMBODIMENTS

Figure 5:
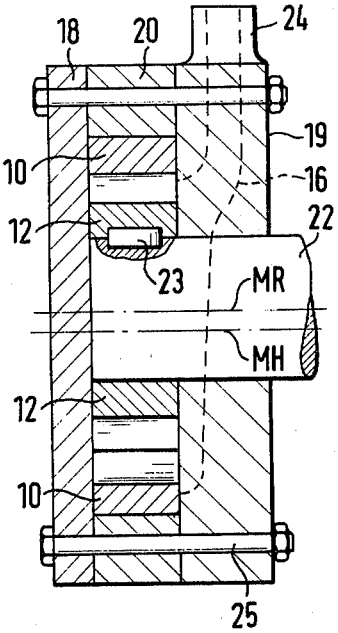
FIG. 5 is a view showing a section of the gear ring pump of the invention, taken along the line 5—5 in FIG. 3.

The gear ring pump shown in FIG. 5 has a housing including a left end plate 18 and a right end plate 19. A ring-shaped housing intermediate part 20 extends between two end plates. The three housing parts define a flat cyclindrical hollow space therebetween.

A hollow gear 10 is located in the hollow space of the housing and has an outer circumferential surface slidingly cooperating with the inner circumferential surface of the housing part 20. The right end plate 19 has a central opening, and a shaft 22 extends through the opening and carries a pinion 12. As schematically shown in the drawing the shaft 22 is connected with the pinion 12 by a wedge 23. It can be seen from FIGS. 3 and 5 that, in the upper region of the gear ring, the pinion and the hollow gear are in full engagement with one another, whereas in the lower region of the gearing the teeth heads of the pinion and the hollow gear slide directly over one another.

An outlet opening 16 extends in the right-hand plate 19, whereas an inlet opening 15 is provided in a part of the end plate 19, located in front of the plane of FIG. 5. A connecting passage extends from the outlet or discharge opening 16 via a pipe 24. The parts 18, 19 and 20 of the housing are connected with one another by threaded pins 25 which are uniformly distributed over the circumference.

The pinion 12 has an axis of rotation identified as MR, and the hollow gear 10 has an axis of rotation identified as MH in FIG. 5. The invention deals with the construction of the gearing for the pump, thereby all other parts of the pump are not shown in the drawing.

Figure 1:
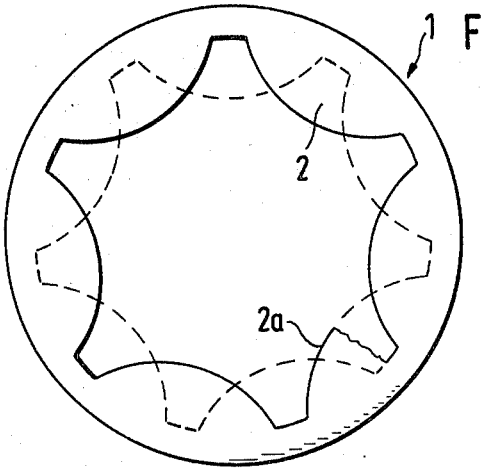
FIG. 1 is a schematic front view of a hollow gear of an Eaton pump from which a pump in accordance with the present invention is derived.

The construction of the gearing in accordance with the invention is derived from an Eaton gearing such as a hollow gear 1 of the Eaton pump in FIG. 1. Each tooth 2 has substantially the shape of a circular segment. The teeth bottom substantially coincide with the tooth root circle of the hollow gear 1. Since the illustrated gearing has eleven teeth, the hollow gear 1 which serves as a theoretical for the construction of the invention has $5\frac{1}{2}$ teeth 2. When in the event of the broken tooth 2*a* the teeth contour is shown in dotted lines, the displacement in accordance with the present invention of the identical teeth shape by a half pitch is attained.

This is true, however, only for the construction of the hollow gears with uneven teeth number. When a hollow gear in accordance with the present invention is designed with even teeth number, the inventive gearing must naturally be derived from an Eaton hollow gear with even teeth number.

Figure 3:
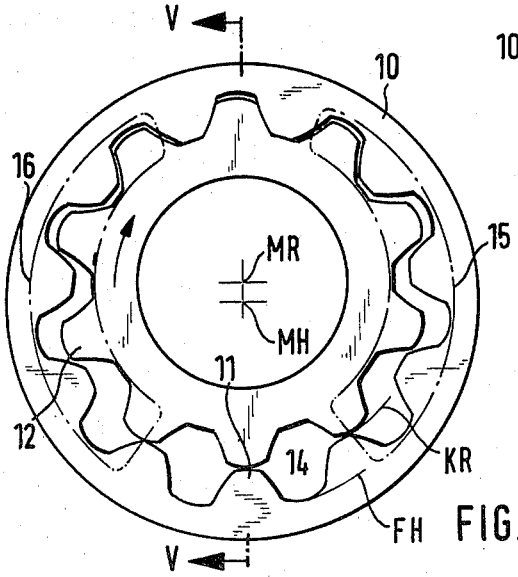
FIG. 3 is a front view of a gear part of the pump in accordance with the present invention.
Figure 2:
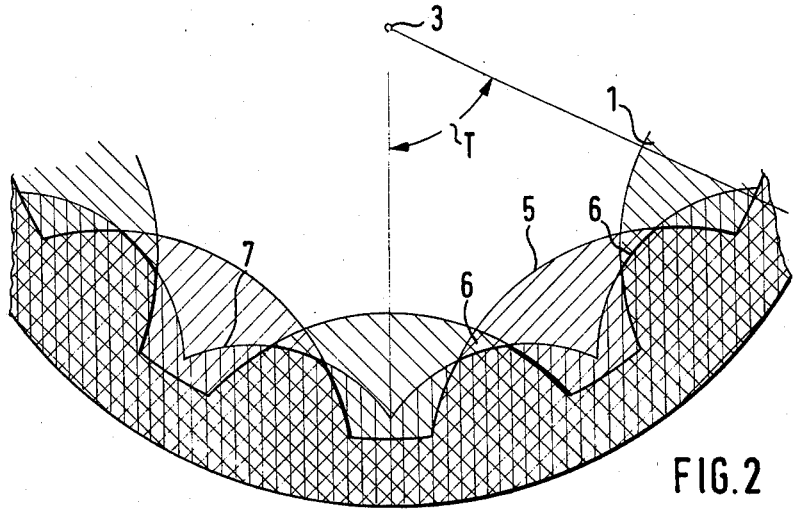
FIG. 2 is a view schematically showing the shape of teeth of the hollow gear of the inventive gear ring pump.

The inventive gearing is derived from an Eaton hollow gear contour 1 having a predetermined teeth number and hatched from left above toward right down. The center of this hollow gear is identified by reference numeral 3. The pitch teeth t is shown only as an angular value. The teeth of the hollow gear contour 1 are limited additionally by a teeth contour 2 which is identical but offset by a half teeth pitch and hatched in FIG. 2 from right above to left below. Thereby the teeth obtain the shape of triangles with equal sides and convexly curved flanks as identified by reference 6. This shape is hatched both from right above towards left below and from left above towards right below. The next step with the thus hatched teeth contour is superposition of a third hollow gear contour 7 whose pitch is equal to half pitch t of the contours 1 and 5. The hollow gear contour 7 is hatched in FIG. 2 from above downwardly. The maximum height of the teeth of the hollow gear contour 7 is smaller than that of the hollow gear contours 1 and 5, so that after the superposition all three hollow gear contours provide such a contour which is hatched from left above toward right below, from right above toward left below, and vertically from above downwardly. Thereby the hollow gear profile in accordance with the present invention is obtained, which is shown in FIG. 3 as provided on a hollow gear 10 whose teeth 11 have the shape derived in FIG. 2 in the above-mentioned manner. In order to design the pinion 12 for the hollow gear, the root circle FH of the hollow gear 10 is rolled over the head circle of the pinion 12. The thus produced contour figure exactly corresponds to the theoretical contour of the pinion 12.

As can be seen from FIG. 3, a drive of the hollow gear 10 by the pinion 12 is performed only in the region of its teeth engagement. At the opposite location, the teeth heads of the highest three teeth of the hollow gear or pinion slide over one another. The intermediate regions located at the right hand and at the left hand in FIG. 3 are such that the teeth of the pinion are completely free from the teeth of the hollow gear. Because of this the teeth flank construction is optimum with respect to the gear mechanics such as specific sliding, surface pressure and the like, on the one hand, and with respect to the sealing at the location of deepest teeth engagement, on the other hand. At the same time, the designer is no longer limited, for forming the teeth heads, by a certain flank construction, but instead the teeth heads curvature can be so selected that practically presureless sliding of the teeth heads over one another opposite to the location of deepest engagement can be attained. Grooved supply spaces 14 between a respective tooth gap of the pinion and the hollow gear practically no longer vary in this region, so that forceful squeezing out of the supply liquid from the supply spaces 14 practically no longer takes place.

In the region of the suction opening 15 and in the region of the pressure opening 16, the supply spaces between the teeth naturally vary, but these spaces as a whole are practically constant over the rotary angle, inasmuch as they are not separated by the teeth engagement.

It can be noted that the inlet opening and the outlet opening having a great length in the inventive construction. Each opening extends over substantially a third of the circumference.

This allows to provide a high number of revolutions. For very high number of revolutions of for example 6000 revolutions per minute or more, the kidney-shaped inlet and outlet can be further extended toward the location of deepest teeth engagement.

Figure 4:
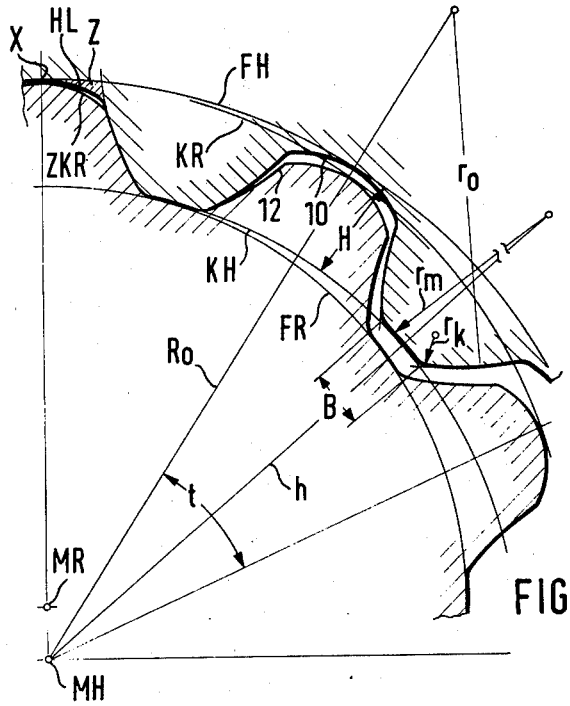
FIG. 4 is an enlarged view of the region of deepest engagement of the hollow gear and pinion of the pump in accordance with the invention.

The construction of the hollow gear and the pinion in accordance with the present invention is shown in FIG. 4. The hollow gear has eleven teeth. The pinion has ten teeth. First of all, the diameter of the theoretical root circle FH of the hollow gear 10 is selected which, for example, is 66 mm. The root circle of the hollow gear is also its rolling circle. The head circle KR of the pinion 12 is its rolling circle. The theoretical teeth height H of the hollow gear is equal to 6 mm. Then a pitch t of the hollow gear with its center MH is formed measured in an angular direction, and a line H subdividing the pitch angle into two halves is formed. Then the desired distance B for the theoretical teeth heads width is formed at two sides of the line H on the head circle KH of the hollow gear 10, the distance B being equal to for example approximately 4 mm so as to extend at both sides of the line H by 2 mm. In such a manner, the crossing points of the flanks circle of the teeth with the head circle KH are obtained. Then a circular arc is formed with a center in a point located outside of FH on a limiting ray of the line H, the circular arc being so dimensioned that the theoretical width of the teeth gaps at the root circle of the hollow gear is equal to substantially 1.05–1.1 of H. In order to attain this, the radius $r_0$ of this circle in the shown example is selected to be equal to 20.66 mm. Then a circle is drawn from a point outside of FH on the line h, through the crossing point of h with KH. The radius of this circle is so selected that a relatively small convexity of the teeth heads measured at the teeth height is produced. This radius rm is selected so as to be equal to 13.8 mm, that is 2.3 H.

Finally, the edges between the head circle with the radius rm and the flank circles with the radius $r_0$ are rounded. For this purpose, in the illustrated example a radius rk equal to 1.9 mm is selected, which merges continuously with common tangent into the circular arcs of the teeth flanks and circular arcs of the teeth heads, as can be seen from FIG. 4. The pinion 12 is now designed as an inner enveloped figure which is obtained by rolling of FH on KR or vice versa. The thus produced shape of the pinion teeth is shown in FIG. 4. As can be better seen at the left side above in FIG. 4, the teeth heads ZKR of the pinion have a contour formed by the teeth heads of the hollow gear 10 and do not fill the teeth gaps of the hollow gear whose bottom is formed by FH. Since thereby dead spaces are produced, a wedge Z between FH and the teeth head curve ZKR hatched in FIG. 4 is so filled that with the teeth gaps of the hollow gear at the location of deepest teeth engagement only a play of for example 0.04–0.05 h between the teeth head curve ZKR of the pinion 12 and the teeth gap bottom of the hollow gear 10 remains. At the location of deepest teeth engagement, because of the construction, the center of the teeth heads curve of the pinion 12 directly contacts the bottom of the teeth gaps of the hollow gear 10, and thereby at this center a small material quantity is removed from the material of the hollow gear, as shown at the left-hand above in FIG. 4, so that the teeth bottom of the hollow gear is limited by the thus produced line HL.

The teeth gaps bottom of the pinion 12, because of the construction of the pinion circumference, abuts at the location of deepest teeth engagement, in the region F in FIG. 4, against the teeth heads of the hollow gear, a small amount is removed from the teeth bottom of the pinion so that the teeth head of the hollow gear also at the location of deepest teeth engagement is free by a value of approximately 0.02–0.03 h. This completes the designing of the hollow gear and the pinion.

The gear ring pump in accordance with the present invention can be utilized for different purposes. They are particularly suitable as lubricating oil pumps for power vehicle piston engines in which the pinion is arranged directly on the crankshaft and a hollow gear is arranged in a casing fixed on the motor housing. Unexpectedly, the gear pumps in accordance with the present invention are not sensitive to deviations of the axes distances to such a high extent that when they are dimensioned as relatively small pumps they can be utilized for great displacements of the crankshaft of a cylinder internal combustion engine.

The utilization of the inventive gear ring pumps is not limited to the above-mentioned purposes. It can also be utilized for other purposes, such as for example as a hydraulic pump.

It will be understood that each of the elements described above, or two or more together, may also find a useful application in other types of constructions differing from the types described above.

While the invention has been illustrated and described as embodied in a gear ring pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A gear ring pump, comprising a housing having an inner hollow and defining a suction side and a pressure side; a hollow gear arranged in said housing and provided with between eight and sixteen teeth; a driven pinion provided with further teeth having by one tooth less than said hollow gear and engaging with said hollow gear so as to form a region of deepest engagement and a region which is opposite to the latter, the teeth heads of said pinion sliding over the teeth of said hollow gear in the opposite region whereas the driving teeth flanks of said pinion abut against the teeth of said hollow gear in said region of deepest engagement so as to provide sealing between said suction side and pressure side, said teeth being formed so that the teeth heads of said pinion are freely received into the teeth gaps of said hollow gear and the teeth of said pinion has a shape determined by rolling of said pinion over said hollow gear, the teeth of said hollow gear having an approximately trapezoidal shape with convexly curved flanks and heads.

2. A gear ring pump as defined in claim 1, wherein said hollow gear has a rolling circle substantially coinciding with its theoretical teeth roots circle, said pinion having a roller circle substantially coinciding with its theoretical teeth head circle.

3. A gear ring pump as defined in claim 1, wherein the teeth and the teeth gaps of said hollow gear extend in a circumferential direction along a circle at the half height of the teeth of said hollow gear, by distances which are substantially equal to one another.

4. A gear ring pump as defined in claim 1, wherein said hollow gear has a predetermined theoretical teeth height, said hollow gear having a teeth heads width without rounding which is equal to between 0.65 and 0.7 of the theoretical teeth height, and a width of the teeth gaps at its theoretical root circle without the rounding which is equal to between 1.05 and 1.1 of the theoretical teeth height.

5. A gearing ring pump as defined in claim 1, wherein said hollow gear has a predetermined theoretical teeth height, the teeth of said hollow gear having a radius of curvature of the teeth heads which is equal to substantially between 2 and 2.4 of the theoretical teeth height of said hollow gear.

6. A gear ring pump as defined in claim 5, wherein said radius of curvature of the teeth heads of said hollow gear is equal to between 2.2 and 2.3 of the theoretical teeth height of said hollow gear.

7. A gear ring pump as defined in claim 1, wherein said hollow gear has a predetermined theoretical teeth height, the teeth flanks of said hollow gear having a radius of curvature of the teeth flanks which is equal to substantially between 3.3 and 3.7 of the theoretical teeth height of said hollow gear.

8. A gear ring pump as defined in claim 7, wherein said radius of curvature of the teeth flanks of said hollow gear is equal to between 3.4 and 3.6 of the theoretical teeth height of said hollow gear.

9. A gear ring pump as defined in claim 1, wherein said hollow gear has a predetermined teeth roots circle, the convexly curved heads of said hollow gear extending along a circular arc with a center which is located at a radius line extending through a teeth center line and is outside of the teeth root circle, the teeth flanks of said hollow gear extending along circular arcs with a center which is also located outside of the teeth root circle.

10. A gear ring pump as defined in claim 1, wherein the teeth flanks which face away from one another and are formed at two neighboring teeth of said hollow gear are located at a common circular arc.

11. A gear ring pump as defined in claim 1, wherein said hollow gear has a predetermined theoretical teeth height, said hollow gear having edges between the teeth flanks and the teeth heads, the edges being rounded along circular arcs which gradually merge into arcs defining the teeth flanks and into arcs defining the teeth heads and have a radius substantially corresponding to one third of the theoretical teeth height of said hollow gear.

12. A gear ring pump as defined in claim 1, wherein said pinion has teeth gaps with a bottom which is worked in a free manner.

13. A gear ring pump as defined in claim 1, wherein said hollow gear has between nine and fifteen teeth.

14. A gear ring pump as defined in claim 13, wherein said hollow gear has between ten and thirteen teeth.

15. A gear ring pump as defined in claim 1; and further comprising a driving shaft arranged to drive said pinion.

* * * * *